US007144441B2

(12) United States Patent
Huang et al.

(10) Patent No.: US 7,144,441 B2
(45) Date of Patent: Dec. 5, 2006

(54) PROCESS FOR PRODUCING MATERIALS REINFORCED WITH NANOPARTICLES AND ARTICLES FORMED THEREBY

(75) Inventors: Shyh-Chin Huang, Latham, NY (US); Pazhayannur Ramanathan Subramanian, Niskayuna, NY (US); Robert John Zabala, Schenectady, NY (US); Roger John Petterson, Guilderland, NY (US); Eric Allen Ott, Cincinnati, OH (US); Srinivasa Range Gowda, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 389 days.

(21) Appl. No.: 10/613,908

(22) Filed: Jul. 3, 2003

(65) Prior Publication Data

US 2005/0000319 A1 Jan. 6, 2005

(51) Int. Cl.
*B22F 9/10* (2006.01)

(52) U.S. Cl. ..... 75/335

(58) Field of Classification Search ..... 75/332, 75/335

See application file for complete search history.

(56) References Cited

U.S. PATENT DOCUMENTS 4,540,546 A 9/1985 Giessen
5,534,086 A 7/1996 Andrus
5,635,654 A 6/1997 Hebsur et al.
5,908,486 A 6/1999 Flinn et al.
6,251,159 B1 * 6/2001 Angeliu et al. ..... 75/414
6,939,388 B1 * 9/2005 Angeliu ..... 75/332

FOREIGN PATENT DOCUMENTS

WO 8203809 11/1982
WO WO-00/37241 A1 * 6/2000

OTHER PUBLICATIONS

Kawabe, A et al., "Fabrication of nanosize SiC particulate reinforced Al alloy composites by using the vortex method", Shizuoka-ken Shizuoka Kogyo Gijutsu Senta Kenkyu Hokuku (1996), Abstract Only.*
EPO Search Report Dated Apr. 12, 2006.

* cited by examiner

*Primary Examiner*—George Wyszomierski
(74) *Attorney, Agent, or Firm*—Paul J. DiConza; Patrick K. Patnode

(57) ABSTRACT

A method for forming a dispersion-strengthened material containing nanoparticles that are uniformly dispersed in a matrix phase. The method includes adding nanoparticles and a molten material to a container to form a pool within the container and rotating the container to create a convection vortex in the pool. The convection vortex is sufficient to cause the nanoparticles to be incorporated into the molten material so as to yield a molten composite material, and further causes the molten composite material to be ejected from the container. The molten composite material is then cooled to form a solid composite body comprising a uniform dispersion of the nanoparticles.

36 Claims, 2 Drawing Sheets

PROCESS FOR PRODUCING MATERIALS REINFORCED WITH NANOPARTICLES AND ARTICLES FORMED THEREBY

BACKGROUND OF THE INVENTION

The present invention generally relates to a process for forming dispersion-strengthened materials. More particularly, this invention relates to a process for dispersing nanoparticles within a liquid-phase material, such as a molten metal, which on solidification yields a body having a uniform dispersion of the nanoparticles.

BRIEF DESCRIPTION OF THE DRAWINGS

Dispersion strengthening phases that are relatively stable in metallic systems are of interest for a variety of structural applications. The potent strengthening effect of AlN precipitates in bulk beta-NiAl alloys and of oxide dispersion-strengthening (ODS) in superalloys has been demonstrated. Examples of the latter include the commercially-available MA754 and MA6000 alloys. To provide a sufficient level of dispersion strengthening, fine dispersoid particles (such as oxides, nitrides, etc.) must be present in a volume fraction and distribution such that the mean free path between particles is sufficiently small to retard the motion of dislocations. However, the incorporation of a relatively uniform, fine-scale distribution of small dispersoid particles into a base metal is difficult, particularly as the size of the particles is reduced. In particular, nano-sized particles (having a dimension of less than a micrometer) tend to agglomerate and not mix in a molten metal pool due to the difference in density between the nanoparticles and the molten material. As a result, it is extremely difficult for nanoparticles initially dispersed in a molten metal to be entrapped during solidification so as to be uniformly dispersed in the solidified metal. A significantly non-uniform distribution of dispersoid does not yield optimum mechanical performance.

Two methods for producing nanoparticle ODS materials have found commercial use, both involving solid-state metal processing. The more frequently used method is a mechanical alloying process that involves a controlled oxidation of metal powder, whose oxide surface layer is fractured and distributed throughout the remaining metal powder by ball-mill grinding. This process may be conducted at ambient, elevated, or cryogenic temperatures, depending on the type of base material being used and the type of dispersion-strengthened material being produced. A disadvantage of the mechanical alloying method is the cost resulting from the long hours of high-energy milling required to disperse the nanoparticles. The second commercial method for producing ODS materials involves internal oxidation and precipitation of oxide particles from a supersaturated metal matrix. However, this method is effectively limited to use with metal systems having solute elements with high thermodynamic stability of oxides and sufficient combinations of oxygen diffusivity and section thicknesses to effectively produce a sufficiently uniform dispersion. Each of the above available techniques for manufacturing dispersion-strengthened materials also have significant process limitations resulting from the need to produce the dispersoid in the solid state rather than the liquid state.

Figure 1:
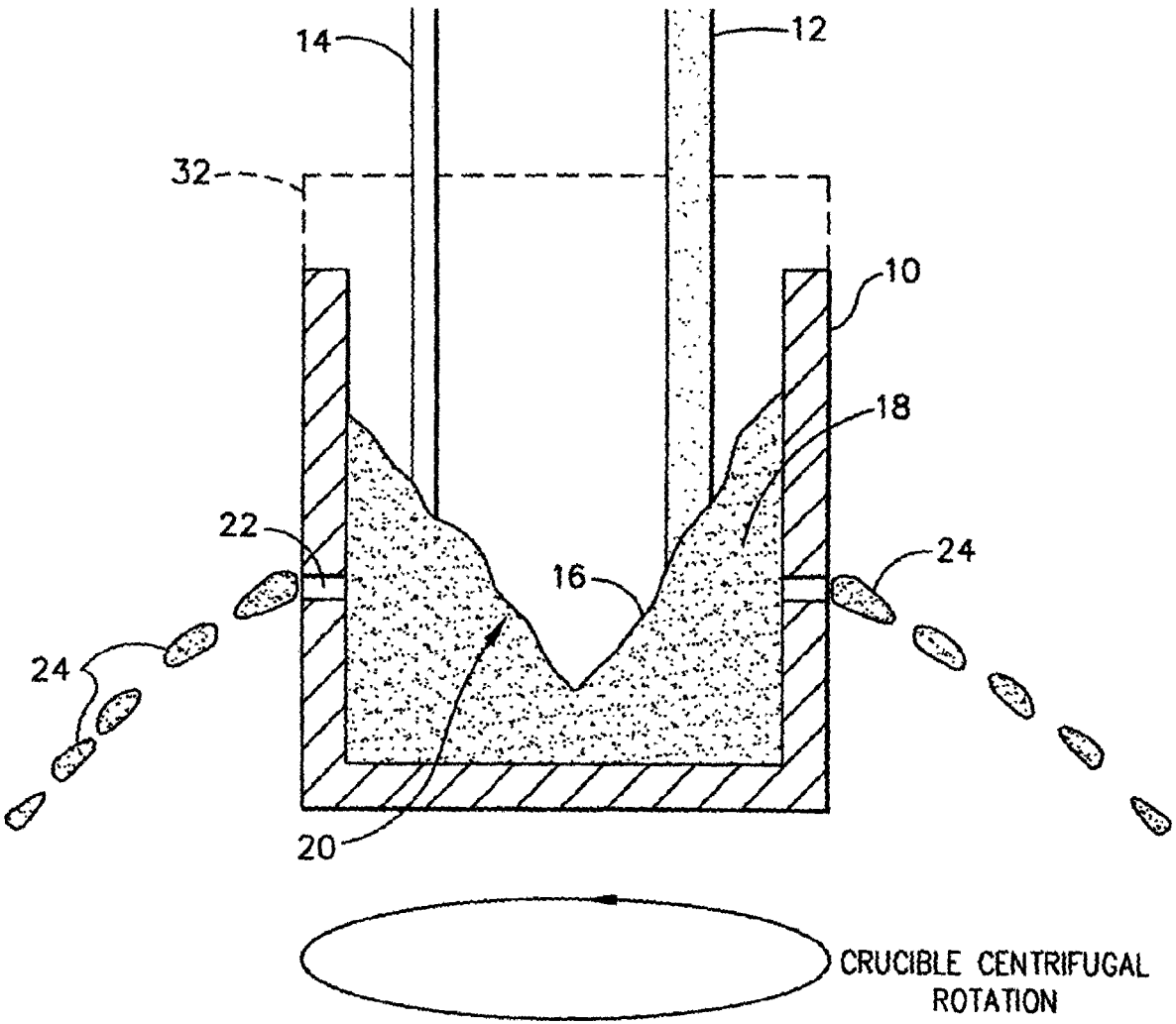

In view of the above, it would be desirable if alternative methods were available by which materials dispersion-strengthened with nanoparticle materials can be manufactured from the molten state. It would be particularly desirable if such a method could make use of a wide variety of combinations of dispersion-strengthening phases and matrix materials, and produce nanoparticle dispersion-strengthened materials in various forms, including finely-divided and bulk form.

BRIEF SUMMARY OF THE INVENTION

The present invention provides a method for forming a dispersion-strengthened material containing nanoparticles (nano-scale particles) that are substantially uniformly dispersed in a matrix phase. The method includes adding nanoparticles to a pool of a molten material within a container that is rotating to create a vortex convection action in the pool. The convection vortex is sufficient to cause the nanoparticles to be incorporated into the molten material so as to yield a molten composite material with a uniform dispersion of the nanoparticles, and further causes the molten composite material to be ejected from the container. The molten composite material is rapidly cooled after ejection from the container, so that a solid composite body is formed comprising the nanoparticles uniformly dispersed in a solidified matrix phase.

According to one aspect of the invention, the molten composite material solidifies to form the solid composite body by contacting a surface (e.g., of a mold) after being ejected from the container. In this manner, the molten composite material is effectively centrifugally spin-cast directly onto the surface. If the surface is that of an appropriately configured mold, the resulting solid composite body can be in the form of a near-net-shape body, a preform or mill product (e.g., a slab, plate or ring). According to another aspect of the invention, the molten composite material solidifies in-flight after being ejected from the container, such that the molten composite material is centrifugally spin-cast into a finely divided form, such as powder particles, flakes, wires or ribbons. Any one or more of these finely-divided forms can be consolidated by thermomechanical techniques (e.g., hot pressing, sintering, HIPing, extrusion, forging, etc.) into bulk near-net-shape components, preforms, or mill product forms containing well-dispersed nanoparticles. Whether the intent is to produce a dispersion-strengthened solid composite body in bulk or finely-divided form, centrifugal mixing of the nanoparticles in the molten material serves to uniformly disperse the nanoparticles, and rapid solidification of the resulting molten composite material initiated by centrifugal ejection from the mixing container ensures that the nanoparticles remain substantially uniformly dispersed during solidification, so that the nanoparticles are also uniformly dispersed in the resulting solid composite body.

In view of the above, it can be seen that a significant advantage of this invention is that it provides a method by which nanoparticle dispersion-strengthened materials can be produced in a finely-divided or bulk form at less expense than conventional mechanically-alloyed ODS materials. If in bulk form, dispersion-strengthened materials can be directly produced as near-net-shape components, preforms or bulk products, thereby avoiding or at least reducing the cost of consolidation, machining, and other operations. The type of dispersion strengthening phase is limited only by availability and compatibility with the matrix phase. Matrix materials that can be used in the method of this invention include phase compositions that are of a more conventional cast or cast-and-wrought type, as well significantly more highly alloyed matrix compositions that can only be effectively produced by rapid solidification techniques. Rapid solidification rates possible with the method of this invention also enable a variety of high-strength matrix materials to be dispersion-strengthened. In addition, appropriate deposition conditions can be employed so that the matrix phase solidifies at a sufficiently rapid rate to have an ultra-fine grain size or ultra-fine grain-sized phases, including nano-sized and amorphous microstructures. The present invention also provides the option for producing bulk product forms with a graded dispersoid spacing and volume fraction in any given direction by varying the rate at which the nanoparticles are added to the molten material.

Other objects and advantages of this invention will be better appreciated from the following detailed description.

BRIEF DESCRIPTION OF THE DRAWINGS

FIG. 1 schematically represents a first centrifugal spin-casting operation of this invention, by which finely-divided solid composite bodies are produced, each containing a uniform dispersion of nanoparticles.

Figure 2:
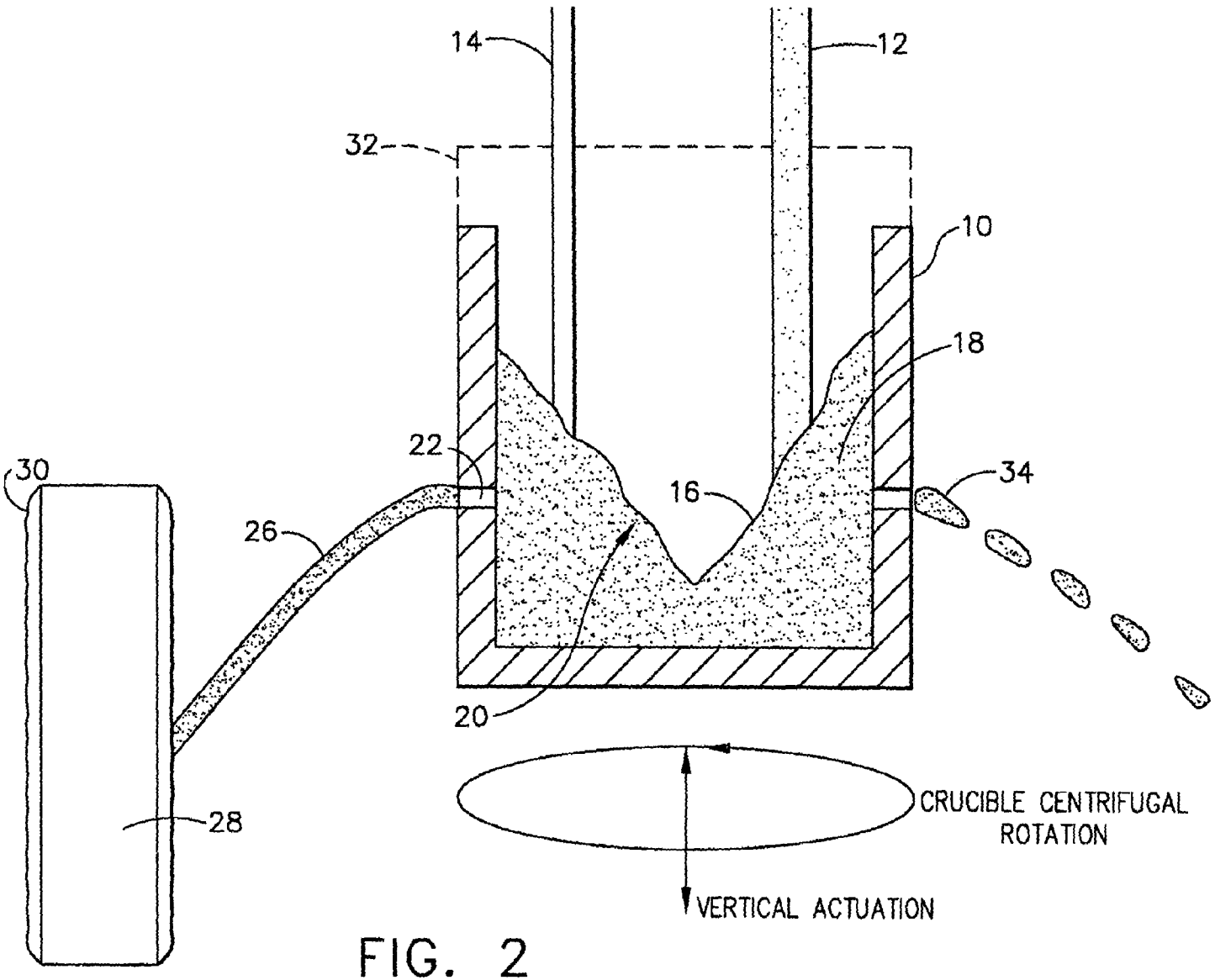

FIG. 2 schematically represents a second centrifugal spin-casting operation of this invention, by which a bulk-deposited solid composite body is produced containing a uniform dispersion of nanoparticles.

DETAILED DESCRIPTION OF THE INVENTION

FIGS. 1 and 2 schematically represent two techniques of this invention by which dispersion-strengthened materials are produced, in which the dispersion reinforcement material includes or is formed entirely of nano-sized dispersoid particles (nanoparticles). In the embodiment represented in FIG. 1, nanoparticles 12 and a molten material 14 are delivered in separate streams to form a pool 16 of molten composite material 18 contained by a crucible 10. As the nanoparticles and molten material 12 and 14 are added to the pool 16, the crucible 10 is caused to spin, rotating about its vertical axis, such as by mounting the crucible 10 to a spinning pedestal (not shown). As will be known by those skilled in the art, crucible materials, crucible constructions, and equipment suitable for this purpose will depend on the type and amount of materials used.

The crucible 10 is caused to spin at a sufficient rate so that the centrifugal force applied by the nanoparticle-filled molten composite material 18 to the wall of the crucible 10 creates a convection vortex 20 within the pool 16, which causes the nanoparticles 12 to immerse and mix into the molten material 14 and thereafter maintains the nanoparticles 12 as a uniform dispersion within the molten material 14. The wall of the crucible 10 is equipped with one or more orifices (nozzles) 22, such that the centrifugal force applied by the pool 16 also causes the molten composite material 18 to be ejected from the crucible 10 through one or more of the orifices 22. In FIG. 1, the crucible 10 is spun so that the molten composite material 18 is ejected as finely-divided droplets that rapidly solidify to form solid composite bodies 24 (schematically represented in FIG. 1), each containing a substantially uniform dispersion of nanoparticles 12. For this purpose, the orifices 22 can be appropriately sized and shaped for the particular molten composite material 18 being processed, so that the solid composite bodies 24 are of a desirable size and form. For example, the smallest dimension of a body 24 may be on the order of about 0.02 mm to about 2 mm, and may be in the form of powder particles, flakes, wires, ribbons, etc. Solid composite bodies 24 in any one or more of these forms can be subsequently made into a bulk form by consolidation using processes known in the art, such as thermomechanical processes that fuse (sinter) the bodies 24 together under pressure and at temperatures below the melting point of the solid matrix phase (or phases) formed by the molten material 14.

In the production of finely-divided particles, flakes, wires, ribbons or other similar materials, processing conditions are used such that the molten composite material 18 quickly solidifies after ejection from the orifices 22 (in-flight) to entrap the nanoparticles 12 in a rapidly solidified matrix phase. In contrast, FIG. 2 represents an embodiment in which some or all of the molten composite material 18 ejected by the crucible 10 is directed onto a mold 28 to directly deposit a solidified composite bulk material 30 on a surface of the mold 28. The molten composite material 18 is shown in FIG. 2 as being ejected as a stream 26 from one of the orifices 22, though the composite bulk material 30 could be deposited from droplets 34 represented in FIG. 2 is being ejected from a second orifice 22. The stream 26 or droplets 34 of composite material 18 can be wholly liquid or, more preferably, in a semisolid form at the moment they deposit on the mold 28, after which the material 18 rapidly solidifies as a result of thermal conduction to the mold 28. While a mold 28 is schematically represented in FIG. 2, the stream 26 or droplets 34 could be deposited on any surface deemed suitable for the particular circumstances.

Depending on the type of mold 28 (or other surface) used, the bulk material 30 can be deposited to form a near-net-shaped component, a preform that can be subsequently processed to form a component, or a mill product such as a slab, plate, or ring, which can be further processed (e.g., forged, machined, coated, heat-treated, etc.) to produce a desired component. Furthermore, the mold 28 (or other surface) can have the shape of a cylinder or plate that can be mounted vertically or horizontally, and can be rotated or translated, so as to increase the size of the deposited area. As implicated in FIG. 2, the container 10 may be vertically actuated to deposit the composite material 18 over a vertical length of the mold 28. The thickness of the bulk material 30 at a given location on the mold 28 can be tailored by appropriately controlling the amount of time that the composite material 18 is deposited at that location. Furthermore, the bulk material 30 can be deposited to have a graded dispersoid volume fraction and spacing in a thickness direction thereof by altering the relative rates at which the nanoparticles 12 and molten material 14 are added to the pool 16.

With each of the embodiments depicted in FIGS. 1 and 2, the crucible 10 can be equipped with a pressurizing unit 32 to aid in ejection of the molten composite material 18, including regulating the rate at which the molten composite material 18 is ejected from a given-size orifice 22. Pressure can be applied at a substantially constant level to promote the ejection of the material 18 in a continuous stream (26 in FIG. 2), or pulsed to aid in breaking up the material 18 into droplets (24 and 34 in FIGS. 1 and 2). Pulsing can also be employed to cause the composite material 18 to be intermittently and selectively ejected in a particular direction from the crucible 10, so that the material 18 is selectively deposited onto the mold 28 (or one or more additional surfaces). For example, with appropriately-sized orifices 22, pulsing the pressure within the container 10 of FIG. 2 can be used to selectively direct the stream 26 onto the mold 28 as represented on the lefthand side of FIG. 2. Alternatively, different pulsing conditions can be used to create droplets 34 as depicted on the righthand side of FIG. 2.

The nanoparticles 12 employed by this invention can have a variety of sizes and compositions. The convection vortex 20 maintained within the crucible 10 is able to disperse particles of extremely fine size, such that nanoparticles as small as about 10 nm can be relatively uniformly dispersed. Particle sizes within a range of about 10 to about 100 nm are of particular interest from the standpoint of processability and strengthening. Suitable compositions for the nanoparticles 12 include oxides, carbides, nitrides, oxycarbides, oxynitrides, carbonitrides, borides, phosphides, intermetallics, and complex combinations of such constituents that are preferably stable during the time the nanoparticles 12 are in contact with the molten material 14 within the pool 16 and the solidified matrix phase of the solidified bodies 24 and bulk material 30, such that the nanoparticles 12 do not undergo any substantial change in quantity, chemistry or size. Because they are not formed in-situ, the nanoparticles 12 can be compounds of elements other than those present in the molten material 14 with which the particles 12 are combined.

A wide variety of matrix materials can be employed with this invention, including conventional cast and cast-and-wrought metal alloys, alloys previously produced only by powder metallurgy techniques, and alloys previously only produced using conventional rapid solidification (RS) techniques. Such materials include but are not limited to aluminum, nickel, cobalt, iron, magnesium, titanium, and copper and their alloys. Cooling rates achievable with this invention can be greater than many conventional casting techniques, making possible the production of solid bodies 24 and bulk materials 30 having finer as-produced matrix grain sizes (e.g., nano-size) than possible with prior art techniques for dispersing nanoparticles in a matrix phase. This aspect of the invention can also permit the use of higher matrix alloying element content, so that additional precipitation-strengthening occurs in the matrix phase during cooling or subsequent thermal processing.

While the invention has been described in terms of one or more particular embodiments, it is apparent that other forms could be adopted by one skilled in the art. Furthermore, the methods of this invention can be employed to produce components for a variety of applications, particularly notable examples of which include components of a gas turbine engine, e.g., rings, cases, blades, vanes, disks, shafts, liners, etc. Therefore, the scope of the invention is to be limited only by the following claims.

What is claimed is:

1. A method for producing a solid material containing a dispersion of nanoparticles, the method comprising the steps of:

adding nanoparticles and a molten material to a container to form a pool within the container and rotating the container to create a convection vortex in the pool, the convection vortex causing the nanoparticles to be incorporated into the molten material so as to yield a molten composite material, the convection vortex further causing the molten composite material to be ejected from the container; and then after ejection from the container, cooling the molten composite material to form a solid composite body comprising the nanoparticles uniformly dispersed in a matrix phase.

2. The method according to claim 1, wherein the nanoparticles are non-reactive with the molten material and the matrix phase of the solid composite body so that the nanoparticles do not undergo any substantial change in quantity, chemistry or size during the adding and cooling steps.

3. The method according to claim 1, wherein the nanoparticles are formed of at least one material selected from the group consisting of oxides, carbides, nitrides, oxycarbides, oxynitrides, carbonitrides, borides, phosphides, intermetallics, and complex combinations thereof.

4. The method according to claim 1, wherein the molten material comprises at least one material selected from the group consisting of aluminum, nickel, cobalt, iron, magnesium, titanium and copper.

5. The method according to claim 1, wherein the matrix phase of the solid composite body has predominantly nano-sized grains.

6. The method according to claim 1, wherein the molten composite material solidifies to form the solid composite body by contacting a mold after being ejected from the container.

7. The method according to claim 6, wherein the solid composite body has a graded dispersoid volume fraction and spacing.

8. The method according to claim 6, wherein the solid composite body is in the form of a near-net-shape body, preform or mill product.

9. The method according to claim 8, further comprising an additional step to physically alter the solid composite body so as to produce a component therefrom.

10. The method according to claim 9, further comprising the step of installing the component in a gas turbine engine.

11. The method according to claim 1, wherein the molten composite material solidifies in-flight after being ejected from the container.

12. The method according to claim 11, wherein the solid composite body is in the form of a powder particle, flake, wire or ribbon.

13. The method according to claim 12, further comprising the step of physically consolidating the solid composite body with a plurality of solid composite bodies produced by the method of claim 12 to form a component therefrom.

14. The method according to claim 13, further comprising the step of installing the component in a gas turbine engine.

15. The method according to claim 1, further comprising the step of pressurizing the container to regulate the rate at which the molten composite material is ejected from the container.

16. The method according to claim 15, wherein the pressure within the container is substantially constant during the ejecting step.

17. The method according to claim 15, wherein the pressure within the container is increased and decreased during the ejecting step so that the molten composite material is intermittently ejected from the container and solidifies in-flight so that the solid composite body is in the form of a powder particle, flake, wire or ribbon.

18. The method according to claim 15, wherein the pressure within the container is increased and decreased during the ejecting step so that the molten composite material is selectively ejected from the container onto a mold where the molten composite material solidifies to form the solid composite body.

19. A method for producing a solid material containing a dispersion of nanoparticles, the method comprising the steps of:

adding nanoparticles and a molten material to a container to form a pool within the container and rotating the container about a vertical axis thereof to create a convection vortex in the pool, the convection vortex causing the nanoparticles to be incorporated into the molten material so as to yield a molten composite material, the convection vortex further causing the molten composite material to be ejected from the container; and then after ejection from the container, depositing the ejected molten composite material on a mold where the ejected molten composite material solidifies to form a solid composite body comprising the nanoparticles substantially uniformly dispersed in a matrix phase;

wherein the nanoparticles are non-reactive with the molten material and the matrix phase of the solid composite body so that the nanoparticles do not undergo any substantial change in quantity, chemistry or size during the adding and depositing steps.

20. The method according to claim 19, wherein the nanoparticles are formed of at least one material selected from the group consisting of oxides, carbides, nitrides, oxycarbides, oxynitrides, carbonitrides, borides, phosphides, intermetallics, and complex combinations thereof.

21. The method according to claim 19, wherein the molten material comprises at least one material selected from the group consisting of aluminum, nickel, cobalt, iron, magnesium, titanium and copper.

22. The method according to claim 19, wherein the matrix phase of the solid composite body has predominantly nano-sized grains.

23. The method according to claim 19, wherein the nanoparticles are added to the pool of the molten material at a variable rate so that the solid composite body has a graded dispersoid volume fraction and spacing in a direction thereof.

24. The method according to claim 19, wherein the solid composite body is in the form of a near-net-shape body, preform or mill product.

25. The method according to claim 19, further comprising an additional step to physically alter the solid composite body so as to produce a component therefrom.

26. The method according to claim 25, further comprising the step of installing the component in a gas turbine engine.

27. The method according to claim 19, further comprising the step of pressurizing the container to regulate the rate at which the molten composite material is ejected from the container, the pressure within the container being increased and decreased so that the molten composite material is selectively ejected from the container onto the mold.

28. A method for producing a solid material containing a dispersion of nanoparticles, the method comprising the steps of:

adding nanoparticles and a molten material to a container to form a pool within the container and rotating the container about a vertical axis thereof to create a convection vortex in the pool, the convection vortex causing the nanoparticles to be incorporated into the molten material so as to yield a molten composite material, the convection vortex further causing the molten composite material to be ejected from the container; and then after ejection from the container, solidifying the molten composite material in-flight from the container to form a plurality of solid composite bodies, each solid composite body comprising the nanoparticles uniformly dispersed in a matrix phase;

wherein the nanoparticles are non-reactive with the molten material and the matrix phase of the solid composite bodies so that the nanoparticles do not undergo any substantial change in quantity, chemistry or size during the adding and solidifying steps.

29. The method according to claim 28, wherein the nanoparticles are formed of at least one material selected from the group consisting of oxides, carbides, nitrides, oxycarbides, oxynitrides, carbonitrides, borides, phosphides, intermetallics, and complex combinations thereof.

30. The method according to claim 28, wherein the molten material comprises at least one material selected from the group consisting of aluminum, nickel, cobalt, iron, magnesium, titanium and copper.

31. The method according to claim 28, wherein the matrix phase of the solid composite bodies has predominantly nano-sized grains.

32. The method according to claim 28, wherein the solid composite bodies are in the form of powder particles, flakes, wires or ribbons.

33. The method according to claim 28, further comprising the step of physically consolidating the solid composite bodies to form a component therefrom.

34. The method according to claim 33, further comprising the step of installing the component in a gas turbine engine.

35. The method according to claim 28, further comprising the step of pressurizing the container to regulate the rate at which the molten composite material is ejected from the container.

36. The method according to claim 35, wherein the pressure within the container is increased and decreased so that the molten composite material is intermittently ejected from the container.

* * * * *